US006648526B2

(12) United States Patent
Kobayashi et al.

(10) Patent No.: US 6,648,526 B2
(45) Date of Patent: Nov. 18, 2003

(54) PRINTING APPARATUS AND PRINTING METHOD

(75) Inventors: Takehito Kobayashi, Yamanashi-ken (JP); Hajime Isono, Yamanashi-ken (JP)

(73) Assignee: Nisca Corporation, Yamanashi-Ken (JP)

( * ) Notice: Subject to any disclaimer, the term of this patent is extended or adjusted under 35 U.S.C. 154(b) by 0 days.

(21) Appl. No.: 10/202,384

(22) Filed: Jul. 25, 2002

(65) Prior Publication Data

US 2003/0021620 A1 Jan. 30, 2003

(30) Foreign Application Priority Data

Jul. 26, 2001 (JP) ..... 2001-226564

(51) Int. Cl.[7] ..... B41J 2/315

(52) U.S. Cl. ..... 400/120.01; 400/120.03; 400/120.04; 400/120.13

(58) Field of Search ..... 400/120.01, 120.13, 400/120.02, 120.03, 120.04

(56) References Cited

U.S. PATENT DOCUMENTS 5,558,449 A * 9/1996 Morgavi ..... 400/188
6,261,012 B1 * 7/2001 Haas et al. ..... 400/208
2002/0036376 A1 * 3/2002 Yui ..... 271/83

FOREIGN PATENT DOCUMENTS

| | | | |
|---|---|---|---|
| JP | 8-58125 | 3/1996 | |
| JP | 8-332742 | 12/1996 | |
| JP | 9-131930 | 5/1997 | |
| JP | 11-263032 | 9/1999 | |
| JP | 2000229432 A * | 8/2000 | ..... B41J/2/325 |

* cited by examiner

*Primary Examiner*—Charles H. Nolan, Jr.
(74) *Attorney, Agent, or Firm*—Kanesaka & Takeuchi

(57) ABSTRACT

A printing apparatus for printing a recording medium includes a recording medium transport device for transporting the recording medium from a supply portion along a transport path; a first printing device arranged on the transport path for forming an image on the recording medium or an intermediate transfer medium through a thermal transfer film; a thermal transfer film transport device for transporting the thermal transfer film; a second printing device arranged on the transport path for transferring the image to the recording medium; and an intermediate transfer medium transport device for moving the intermediate transfer medium back and forth relative to the second printing means. A control device controls the printing apparatus so that the second printing device prints at the same time the thermal transfer film is being transported for the first printing device to print the thermal transfer film.

6 Claims, 9 Drawing Sheets

PRINTING APPARATUS AND PRINTING METHOD

BACKGROUND OF THE INVENTION AND RELATED ART STATEMENT

This invention relates to a printing apparatus and a printing method for printing a variety of information such as images and characters on a recording medium, such as a card. More particularly, this invention relates to a printing apparatus and a printing method that are capable of switching printing methods according to characteristics of a recording medium or information for printing a variety of information.

Conventionally, a thermal transfer printing apparatus has been used to record a desired image or a character on a card recording medium such as a credit card, a cash card, a license card or an ID card by thermally transferring with a thermal head via a thermal transfer film. As an example, in Japanese Patent Publication (TOKKAI) No. 09-131930, a printing apparatus using a direct transfer method has been disclosed. The apparatus directly transfers an image and a character to a recording medium via a thermal transfer film. This method has an advantage of attaining a high quality image due to thermal sublimate ink. However, the recording medium needs to have a receptive layer on its printing surface to receive the ink. Therefore, only limited recording medium can be used, or the receptive layer needs to be formed on the surface of the recording medium.

Generally, a card made of a polyvinyl chloride (known as a PVC card) has been widely used as the recording medium that can receive the thermal sublimate ink. However, since the PVC card generates toxic substances when burned, recently it has been tried to switch to a card made of a polyethylene terephthalate (also known as a PET card).

Furthermore, in recent years, a new type of card media such as an IC card, which embeds an IC chip or antenna inside, has been used in a variety of fields. Because of the embedded elements, this type of card has an uneven surface, resulting in a printing problem.

In Japanese Patent Publication (TOKKAI) No. 08-332742, a printing apparatus using an indirect transfer technology, in which an image is transferred to an intermediate transfer medium once then transferred to a final recording medium, has been disclosed to solve the above problem. According to this method, it is possible to overcome the problems such as limited recording medium related to the receptive layer or the issue of printing on an uneven surface of the recording medium. Furthermore, this method makes it easier to print an image on an entire surface of the card medium as opposed to the direct transfer method.

In Japanese Patent Publication (TOKKAI) No. 11-263032, an image forming portion for forming an image on a belt-shaped transfer sheet (an intermediate transfer film) is disposed at an upper portion, and a retransfer portion for re-transferring the image transferred to the transfer sheet to a card as the received image is disposed at lower portion. When the image is formed on the transfer sheet, the sheet is transported in a vertical direction with respect to the apparatus. While the card is being transported in a horizontal direction after passing a sheet return path, the image is re-transferred to the card.

Further, in Japanese Patent Publication No. 08-58125, a thermal transfer printing apparatus that prints simultaneously to both front and back surfaces of a recording paper is disclosed. The apparatus is configured to have two printing mechanisms; namely a mechanism of transferring an ink image to a recording paper surface by a heat roller after forming an image on an intermediate transfer film using a thermal head, and another mechanism of transferring an ink to a backside of the recording paper with another thermal head different from the aforementioned thermal head. The thermal head for transferring the ink to the backside of the recording paper surface through an ink film is arranged at a side opposite to the heat roller for the re-transfer process.

However, in the intermediate transfer method, a running cost tends to be higher than that of the direct transfer method because of the intermediate transfer medium. Also, it takes longer time to finish printing. Furthermore, in terms of a card design, there are many cases where a front side needs to be printed on a whole area while only limited area such as precautions for card use is needed to print on a backside. Thus, there are merits and demerits for both printing methods. In Japanese Patent Publication No. 11-263032, an image forming process and a re-transferring process can be performed simultaneously, but the apparatus can handle only the aforementioned indirect transfer method. Also, in Japanese Patent Publication No. 08-058125, a disclosed technology for simultaneous processing on both sides is limited to the same recording paper. When a process error occurs while processing both sides, it is necessary to re-form an image for not only either side but also a recording sheet on the intermediate transfer film. Furthermore, to properly print on both sides of the same recording paper with the thermal transfer printing apparatus disclosed in the publication, as both sides of the recording paper are heated, it becomes difficult to peel the intermediate transfer film off because of a high temperature.

Therefore, it is possible to reduce a running cost by selecting a method most appropriate to a recording medium if a printing apparatus can switch between the direct transfer method and the indirect transfer method to print an image on a recording medium depending on an objective of printing such as an entire surface printing. Also, and if it is possible to select either of at least the direct transfer method and the indirect transfer method without limitation to the front and back sides of the same recording medium and printing simultaneously to a plurality of recording medium, printing times can be shortened, thereby resulting in the expanded use of such a printing apparatus.

An object of the present invention is to provide a printing apparatus that can switch between the direct transfer method and the indirect transfer method for printing and shorten a print processing time.

Another object of the present invention is to provide a printing apparatus that reduces an operating cost associated with printing and simplifies a printing process as well as improves a printing speed while meeting an increasing demand for both the direct transfer method and the indirect transfer method for printing a recording medium.

Still another object of the present invention is to provide a printing method that can switch between the direct transfer method and the indirect transfer method and shorten a print processing time.

Further objects and advantages of the invention will be apparent from the following description of the invention.

SUMMARY OF THE INVENTION

To attain the objectives, in the first aspect of the present invention, a printing apparatus is equipped with a recording medium transport device for transporting a recording medium supplied from a supply portion along a transport path; at least one first printing device arranged on the transport path of the recording medium transport device for selectively forming an image on the recording medium via a thermal transfer film with an ink layer and on an intermediate transfer medium for temporarily holding the image; a thermal transfer film transport device for transporting the thermal transfer film; a second printing device arranged on the transport path of the recording medium transport device for transferring the image formed on the intermediate transfer medium on the recording medium or another recording medium; an intermediate transfer medium transport device for reciprocating the intermediate transfer medium with regard to the second printing device; and a control device for controlling the second printing device to execute the image forming at the same time when transporting the thermal transfer film for forming the image by the first printing device.

In this aspect, the recording medium transport device transports the recording medium from the supply portion along the transport path. At least one first printing device is arranged on the transport path of the recording medium transport device, and the first printing device forms an image selectively on a recording medium via a thermal transfer film having an ink layer and on an intermediate transfer medium that temporarily holds the image. When the first printing device forms the image, the thermal transfer film transport device transports the thermal transfer film. Also, the second printing device is arranged on the transport path of the recording medium transport means, and the second printing device transfers the image formed on the intermediate transfer medium to the same recording medium or another recording medium. The intermediate transfer medium transport device moves back and forth the intermediate transfer medium with regard to the second printing device. Also, the control device controls the second printing means so that the image forming is executed in parallel to the transporting of the thermal transfer film when the first printing device forms the image. According to this aspect, the first printing device transfers the image directly to the recording medium, and the second printing device transfers the image indirectly to the recording medium or another recording medium. Thus, it is possible to switch between the direct transfer method and the indirect transfer method to print the recording medium. Also, because the second printing device forms the image while transporting the thermal transfer film for the first printing device to form the image, the second printing device and the first printing device form the image simultaneously, thereby shortening a processing time for printing several recording media.

Further in this aspect, a recording medium turning portion may be arranged on the transport path of the recording medium transport device and between the first printing device and the second printing, device for rotating or inverting the recording medium. The first printing means forms an image on one side of the recording medium and the second printing device forms an image on the other side of the same or another recording medium. In this case, it becomes possible to change a transport direction of the recording medium using the recording media turning portion. Therefore, after the first printing device forms the image on one side of the recording medium, it is possible to form the image on the other side sequentially using the second printing device to enable double-side printing.

In the second aspect of the present invention, an printing apparatus is equipped with a recording medium transport device for transporting a recording medium supplied from a supply portion along a transport path; at least one first printing device arranged on the transport path of the recording medium transport device for selectively forming an image on the recording medium and an intermediate transfer medium for temporarily holding the image; a second printing device arranged on the transport path of the recording medium transport device for transferring the image formed on the intermediate transfer medium on the recording medium or another recording medium; an intermediate transfer medium transport device for reciprocating the intermediate transfer medium with regard to the second printing means; a mode setting device for selecting a mode between the first mode in which the first printing device forms the image on the recording medium and the second mode in which the second printing device transfers the image formed on the intermediate transfer medium by the first printing device to the same or another recording medium; and a control device for controlling the second printing device to form the image at the same time when transporting the intermediate transfer medium back and forth for forming the image on the intermediate transfer medium by the first printing device.

In this aspect, the recording medium transport device transports the recording medium from the supply portion along the transport path. At least one first printing device is arranged on the transport path of the recording medium transport device, and the first printing device selectively forms the image on a recording medium and on an intermediate transfer medium that temporarily holds the image. Also, the second printing device is arranged on the transport path of the recording medium transport device, and the second printing device transfers the image formed on the intermediate transfer medium to the recording medium or another recording medium. The intermediate transfer medium transport means moves the intermediate transfer medium reciprocally with regard to the first and the second printing devices. In the mode setting means, it is selected to use the first mode for forming the image an the recording medium using the first printing device or the second mode for transferring the image formed on the intermediate transfer medium by the first printing means to the same or a different recording medium using the second printing means. The control device controls the second printing device to forms the image in parallel to the back and forth transportation of the intermediate transfer medium when the first printing device forms the image on the intermediate transfer medium. According to this aspect, when the printing apparatus uses the first mode, the first printing device transfers the image directly to the recording medium. When set to use the second mode, the second printing device prints the image indirectly on the recording medium or another recoding medium. Therefore, it is possible to switch between the direct transfer method and the indirect transfer method to print the recording medium. Also, because the second printing device forms the image on the recording medium in the second mode while reciprocally transporting the intermediate transfer medium for the first printing device to form the image, the second printing device and the first printing device form the image simultaneously, thereby shortening a processing time for printing several recording media.

In this embodiment, a parallel drive device may be provided to drive the recording medium transport device to transport the recording medium to the second printing device and the intermediate transfer medium transport device to transport the intermediate transfer medium in parallel. Thus, it is possible to transport the recording medium and the intermediate transfer medium back and forth independently in parallel so the transporting time associated with printing is shortened.

Furthermore, in the third aspect of this invention to attain the aforementioned objectives, a printing method includes the first image forming process and the second image forming process. In the first image forming process, the first recording medium or an intermediate transfer medium for temporarily holding an image is transported to the first image forming position, and an image is formed selectively on the first recording medium or the intermediate transfer medium at the first image forming position. In the second image forming process, the second recording medium is transported to the second image forming position, and the image formed on the intermediate transfer medium is transferred at the second image forming position. At least a part of the first image forming process and a part of the second image forming process are executed simultaneously.

According to this aspect, in the first image forming process, the first recording medium and the intermediate transfer medium are transported to the first image forming position, and the image is selectively formed to the first recording medium or the intermediate transfer medium at the first image forming position. In the second image forming process, the second recording medium is transported to the second image forming position, and the image formed on the intermediate transfer medium is transferred to the second recording medium at the second image forming position. At least a portion of the first image forming process and a portion of the second image forming process are executed simultaneously. According to this aspect, the image is directly transferred to the first recording medium in the first image forming process and indirectly transferred to the second recording medium in the second image forming process. Therefore, while it is possible to switch between the direct transfer method and the indirect transfer method when printing the recording medium, at least a portion of the first image forming process and a portion of the second image forming process are executed simultaneously thereby shortening the print processing time. In such a case, it is acceptable to form the image on the second recording medium in the second image forming process while moving the first recording medium and the intermediate transfer medium back and forth when forming the image on the first recording medium and the intermediate transfer medium.

Other objectives and features of the present invention shall be clearly explained in a detailed description of the preferred embodiment below based upon the drawings provided.

BRIEF DESCRIPTION OF THE DRAWINGS

FIGS. 4A and 4B are explanatory drawings of a thermal transfer sheet and an intermediate transfer sheet, wherein FIG. 4A is a front view showing a model of the thermal transfer sheet, and FIG. 4B is a sectional view showing a model of the intermediate transfer sheet;

FIGS. 5A–5C are front views of the image forming portion of the printing apparatus according to the embodiment of the present invention, wherein FIG. 5A shows a state that a thermal head is retracted, FIG. 5B shows a state that an image is formed on a card by a direct transfer, and FIG. 5C shows s state that an image is formed on the intermediate transfer sheet;

FIG. 6B shows a state that an image is formed on a card by an indirect transfer;

DETAILED DESCRIPTION OF PREFERRED EMBODIMENTS

Hereunder, embodiments of the invention will be explained with reference to the accompanied drawings.

Figure 1:
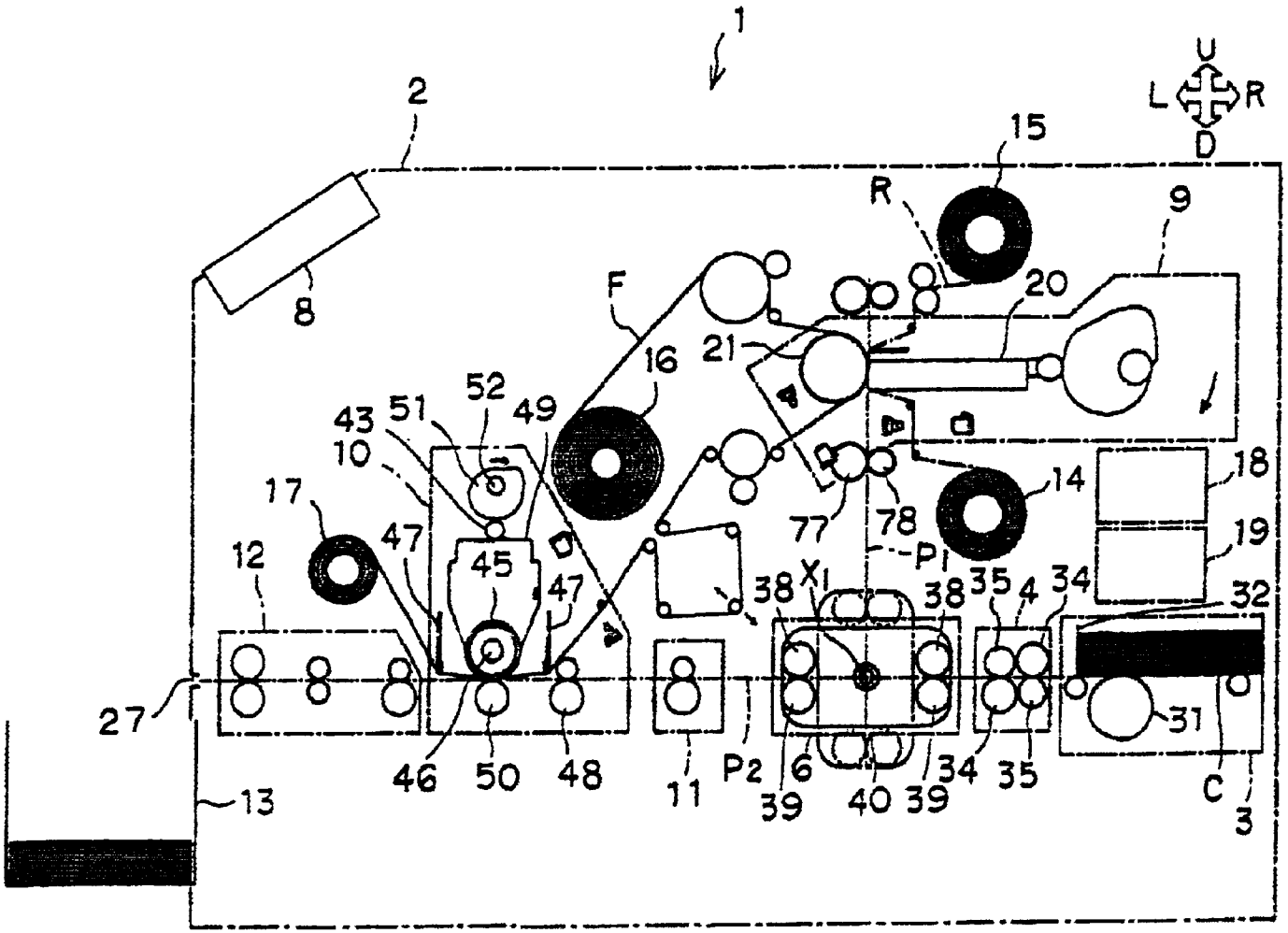
FIG. 1 is a front view showing a general configuration of a printing apparatus according to an embodiment of the present invention.

As seen in FIG. 1, according to an embodiment of the present invention, a printing apparatus 1 in a housing 2 comprises the first card transport path P1 for forming (printing) an image on the card C using the direct transfer method and the second card transport path P2 for transferring an image temporarily held on an intermediate transfer sheet F as an intermediate transfer medium to the card C using an indirect transfer method. The second card transport path P2 is disposed substantially horizontally, and the first card transport path P1 is disposed substantially vertically. The first card transport path P1 and the second card transport path P2 intersect each other at an intersecting point X1.

On the second card transport path P2 are arranged a card supply portion 3 for separating and feeding the card C one by one to the second card transport path P2, a cleaner 4 for cleaning a front surface of the card C at downstream of the card supply portion 3, and a turning portion 6 for rotating the card C around the intersection point X1 while nipping the card C to switch the card C transport path directly toward the first card transport path P1 at downstream of the cleaner 4.

The card supply portion 3 comprises a card stacker to store a stack of blank cards C. A stacker side plate 32 with an opening slot to allow only one card C to pass therethrough is arranged at a position facing the second card transport path P2 on the card stacker. To a bottom of the card stacker is pressingly arranged a kick roller 31 for feeding the bottommost blank card C in a stack stored in the card stacker to the second card transport path P2.

The cleaner 4 comprises a cleaning roller 34 made of a rubber with a sticky surface and a pressing roller 35 to press and face each other at the second card transport path P2.

The turning portion 6 comprise a pair of pinch rollers 38 and 39 that are capable of nipping the card C and a rotating frame 40 for supporting these pinch rollers to rotate or invert around the intersecting points of X1. One of the pinch rollers 38, 39 is a driving roller, and the other follows a drive of the other roller. The pinch rollers 38 and 39 press together sandwiching the second card transport path P2 when the rotating frame 40 is in a horizontal state (shown by a solid line in FIG. 1) and press together sandwiching the first card transport path P1 when the rotating frame 40 is in a vertical state (shown by a projected line in FIG. 1). When the rotating frame 40 is rotated or inverted while nipping the card between the pinch rollers 38 and 39, the pinch rollers 38 and 39 rotate together to displace the card C. Thus, the rotating or turning action at the first turning portion 6 is driven independently from the rotation or inversion of the rotating frame 40 and the rotation of the pinch rollers 38 and 39.

A unit transmission sensor (combined with a slit plate), not shown in the drawings, to detect a rotational angle of the rotating frame 40 is disposed near the turning portion 6. Also, in order to determine a rotational direction of the pinch rollers 38 and 39, a unit transmission sensor (combined with a semi-circular plate), not shown in the drawings, is disposed to detect a position of either of the pinch rollers 38 and 39, so it is possible to set a rotating angle of the rotating frame 40 and control a transport direction of the card C by the pinch rollers 38 and 39. Furthermore, to detect the card C, unit transmission sensors, also not shown in the drawings, are arranged near both sides of the turning portion 6 on the second card transport path P2 and between the turning portion 6 and an image forming portion 9 (described later) on the first card transport path P1.

The image forming portion 9 for forming an image on the intermediate transfer sheet, which is described below, or the card C using the thermal transfer ink according to the image or character image information is arranged at downstream of the turning portion 6 (the direction of arrow U in FIG. 1) on the first card transport path P1. The image forming portion 9 employs a configuration of a thermal transfer printer and comprises a platen roller 21 for supporting the card C when printing to a surface thereof and a thermal head 20 retractably arranged to the platen roller 21. The thermal transfer sheet R is interposed between the platen roller 21 and thermal head 20.

Figure 5A:
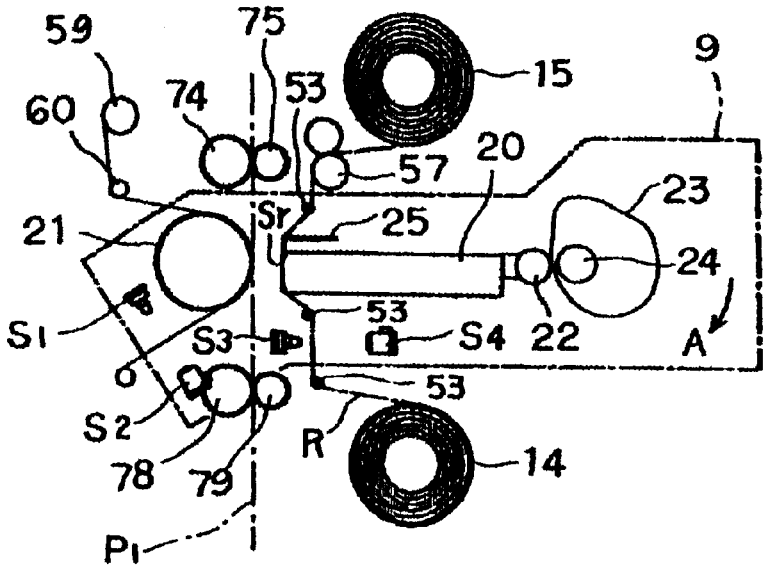
Figure 5B:
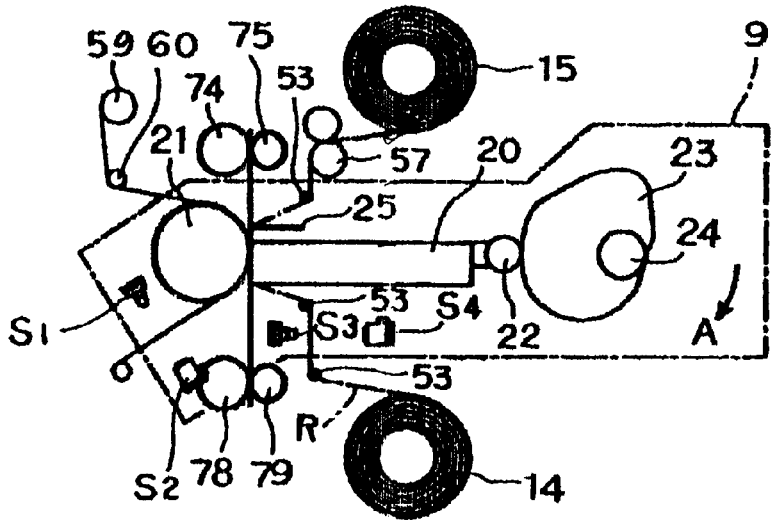
Figure 5C:
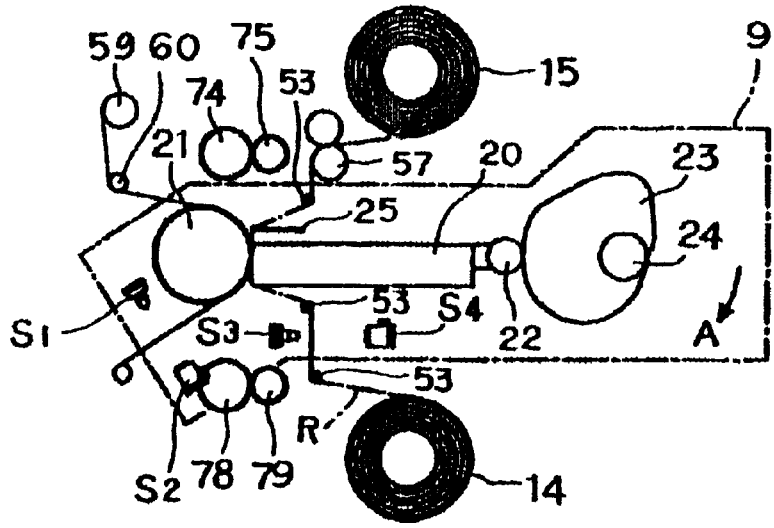

As shown in FIG. 5A to FIG. 5C, the retracting movement of the thermal head 20 relative to the platen roller 21 is performed by a thermal head sliding drive unit having a removable holder (not shown) for supporting the thermal head 20; a follower roller 22 fastened to the holder; a non-circular thermal head sliding cam 23 rotating in either direction (the arrow direction A or the opposite in FIGS. 5A–5C) around the cam shaft 24 while following an outer contour of the follower roller 22; and a spring (not shown) to press the holder against the thermal head sliding cam 23.

Figure 4A:
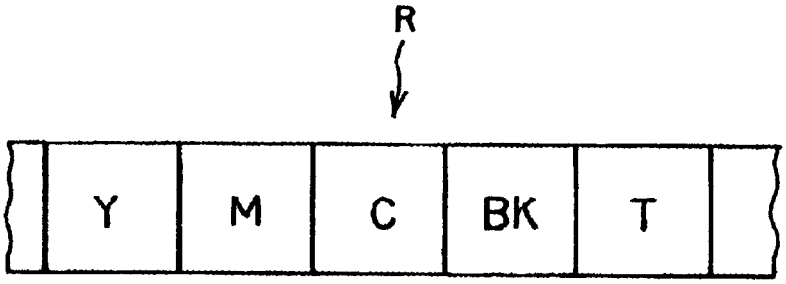

As shown in FIG. 4A, the thermal transfer sheet R sequentially carries inks, Y (yellow), M (magenta), C (cyan) and Bk (black), on the film in a width slightly larger than a length of the card C. A protective layer region T for protecting the card C surface is formed thereon next to the Bk (black), and this pattern is repeated along the film.

As shown in FIG. 5A and FIG. 5B, the thermal transfer sheet R is supplied from the thermal transfer sheet supply portion 14 where the thermal transfer sheet R is wound in a roll. The thermal transfer sheet R is guided by a plurality of guide rollers 53 and the guide plate 25 fastened to the holder (not shown), then is driven along with a rotation of a pair of take-up rollers 57 while contacting substantially the entire surface of the leading edge of the thermal head 20. Finally, the sheet is rolled on the thermal transfer sheet take-up portion 15. The thermal transfer sheet supply portion 14 and the thermal transfer sheet take-up portion 15 are disposed at both sides of the thermal head 20, and the centers thereof are mounted onto the spool shaft. In the image forming portion 9, a mark for positioning of the thermal transfer sheet R, a light emitting element $S_3$, and a light receiving element $S_4$ for detecting the Bk portion on the thermal transfer sheet R are arranged between the guide rollers 53, which are disposed between the thermal transfer sheet supply portion 14 and the thermal head 20, being away from and perpendicular to the thermal transfer sheet R.

Note that a gear (not shown) is attached to a roller shaft of a pair of the take-up rollers 57 at a drive side, and engages another gear with a clock plate (not shown) on the same shaft. A unit transmission sensor (not shown) is disposed near the clock plate (not shown) for detecting the rotation of the clock plate to control a wound amount of the thermal transfer sheet R.

As can be seen in FIG. 5A, a printing position (a heating position) Sr of the thermal head 20 with respect to the card C (or the intermediate transfer medium F shown later) through the thermal transfer sheet R is located on an outer circumference of the platen roller 21 corresponding to the first card transport path P1. On both sides of the image forming portion 9 are arranged a pair of rollers comprising a capstan roller 74 rotating a constant speed and a pinch roller 75 pressing thereto; and a pair of rollers comprising a capstan roller 78 and a pinch roller 79. The rollers sandwich the first card transport path P1.

Figure 4B:
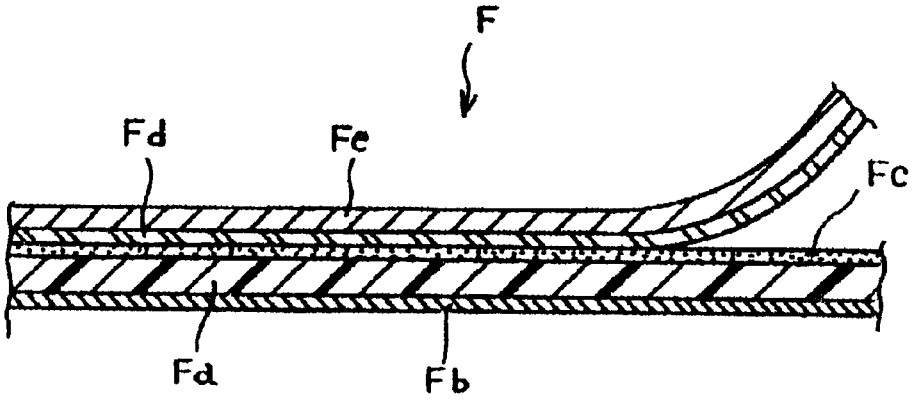

As shown in FIG. 1 and FIGS. 5A to 5C, the intermediate transfer sheet F is wound around the platen roller 21. As shown in FIG. 4B, the intermediate transfer sheet F is a laminated film formed of a base film Fa; a back surface coating layer Fb formed on a backside of the base film Fa; a receptive layer Fe for receiving ink; an overcoat layer Fd for protecting the receptive layer surface; and a peeling film Fc. The peeling film Fc is formed on a front side of the base film Fa, and facilitates separation from the base film Fa by the thermally bonding the overcoat layer Fd and the receptive layer Fe. They are laminated in a order of the back surface coating layer Fb, the base film Fa, the peeling film Fc, the overcoat layer Fd, and the receptive layer Fe from the bottom. The intermediate transfer sheet F is wound with the receptive layer Fe facing the thermal transfer sheet R and the back coating layer Fb side contacting the platen roller 21. When one side of the card C is printed at the printing position Sr by the direct printing method (see FIG. 5B) or the intermediate transfer sheet F is printed at the printing position Sr by the indirect printing method (see FIG. 5C), a transport speed of the intermediate sheet F is set to be the same as that of the thermal transfer sheet R. As shown in FIG. 5A to 5C, in the image forming portion 9, a light emitting element $S_1$ and a light receiving element $S_2$ for detecting a positioning mark of the intermediate transfer sheet F are arranged between the platen roller 21 and guide roller 91, being away from and perpendicular to the intermediate transfer sheet F.

Furthermore, in the printing apparatus 1 as shown in FIG. 1, on the second card transport path P2 at downstream of the first turning portion 6 (the arrow L side) are disposed in series a pair of horizontal transport rollers 11 to transport the card C in a horizontal direction; a transfer portion 10 to transfer an image formed on the intermediate transfer sheet F at the image forming portion 9; and a horizontal transport portion 12 comprising a plurality of transport rollers to transport the card C horizontally and discharge rollers to discharge the card C to outside of the frame 2.

The transfer portion 10 comprises a platen roller 50 for supporting the card C when transferring an image from the intermediate transfer sheet F to the card, and a heat roller 45 arranged to slide with respect to the platen roller 50. Disposed in the heat roller 45 is a heating lamp 46 to heat the intermediate transfer sheet F. The intermediate transfer sheet F is interposed between the platen roller 50 and heat roller 45.

Figure 6A:
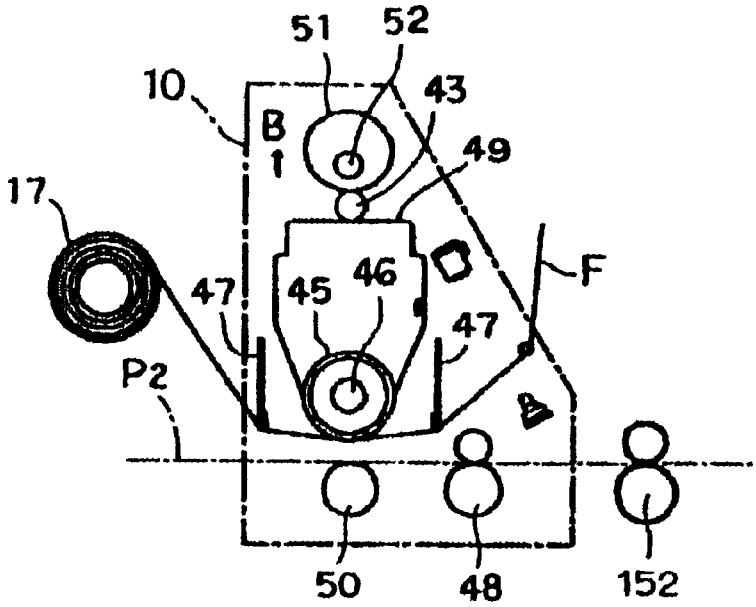
FIGS. 6A and 6B are front views of a transfer portion of the printing apparatus according to the embodiment of the present invention, wherein FIG. 6A slows a state that a heat roller is retracted.
Figure 6B:
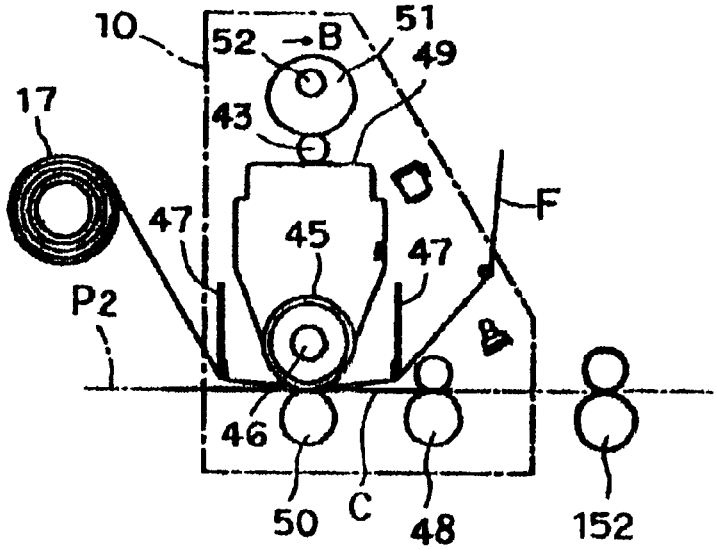

As shown in FIG. 6A and FIG. 6B, the heat roller 45 is moved with respect to the platen roller 50 by a vertical driving unit comprising a holder 49 supporting the heat roller 45 to be detachable; a follower roller 43 fastened to the holder 49; a non-circular heat roller lifting cam 51 rotating in a direction (a direction of arrow B in FIG. 6A) around a cam shaft 52 while contacting an outer surface of the follower roller 43; and a spring (not shown) disposed in the holder 49 for pressing the holder 49 against the heat roller lifting cam 51.

Figure 7:
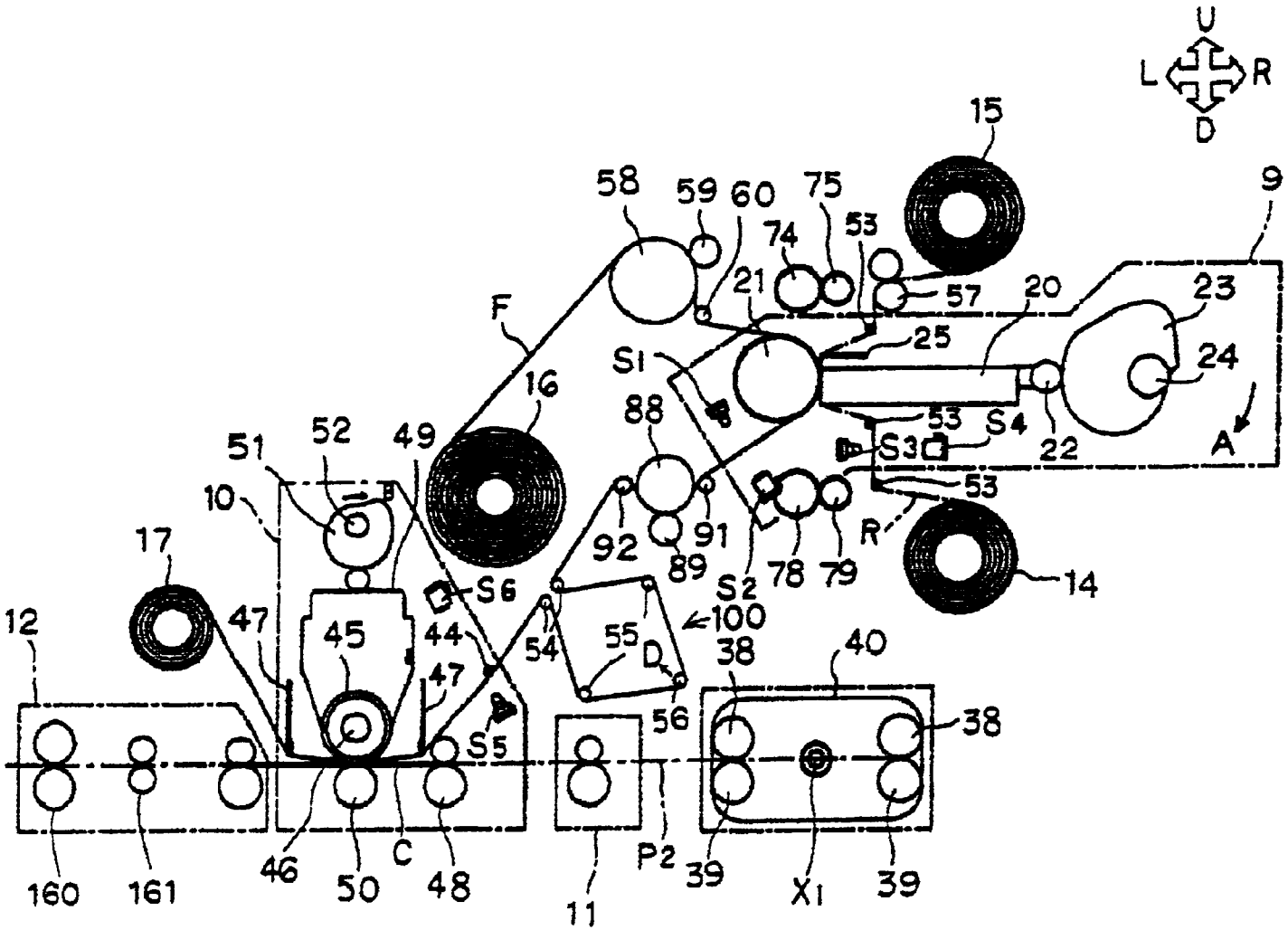
FIG. 7 is a front view of the printing apparatus according to the embodiment of the present invention, showing a state of mode B.

As can be seen in FIG. 7, the intermediate transfer sheet F is supplied from the intermediate transfer sheet supply portion 16 where the intermediate transfer sheet F is wound in a roll. The intermediate transfer sheet F is guided through such components as a transport roller 58 accompanied by a follower roller 59; a guide roller 60; the platen roller 21; a guide roller 91; a back-tension roller 88 for applying a tension to the intermediate transfer sheet F along with a pinch roller 89; a guide roller 92; a intermediate transport buffer 100 comprising guide rollers 54, 55 and a guide roller 56 movable in the arrow direction D and its opposite direction; a guide roller 44; a guide plate 47 disposed between the guide roller 44 and the heat roller 45 and fixed to a frame constituting the transfer portion 10. When transferring, the intermediate transfer sheet F is sandwiched between the platen roller 50 and heat roller 45 on the second card transport path P2 via the card C, and is taken up by the intermediate transfer sheet take-up portion 17 that takes up the intermediate transfer sheet F. Furthermore, a pair of transport rollers 48 pressing together is disposed in the transfer portion 10 to transport the card C on the second card transport path P2 in the arrow direction L in FIG. 1, sandwiching the second card transport path P2 at downstream of a pair of horizontal transport rollers 11 and upstream of the platen roller 50. Furthermore, in the image forming portion 10, a light emitting element $S_5$ and a light receiving element $S_6$ are arranged on both sides of the intermediate transfer sheet F between the guide roller 44 and guide plate 47 for detecting a positioning mark of the intermediate transfer sheet F.

Figure 2:
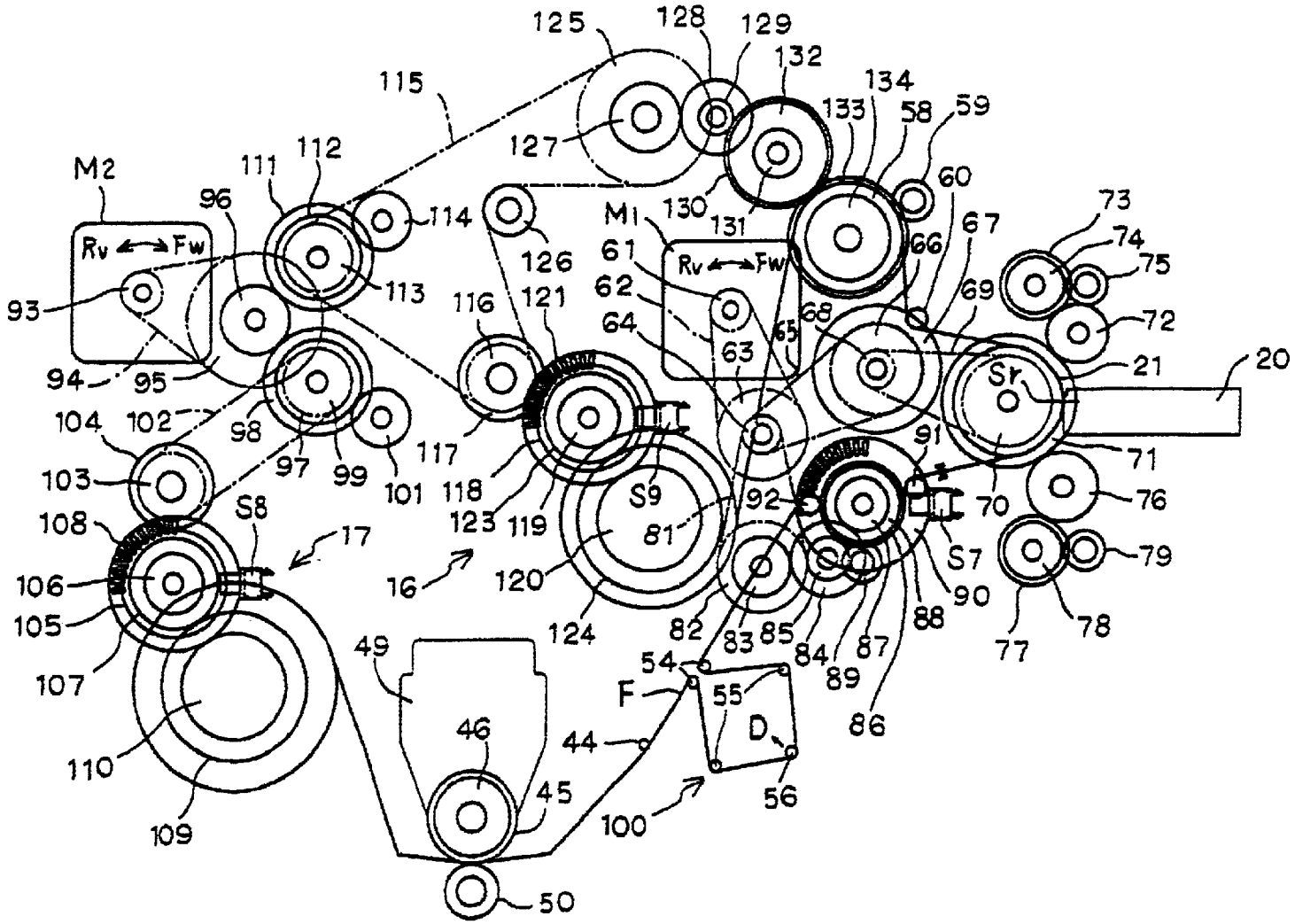
FIG. 2 is a front view showing a card transport mechanism near an intermediate transfer sheet transport mechanism and an image forming portion of the printing apparatus according to the embodiment of the present invention.

As seen in FIG. 2, in a region defined by the housing 2 and the first and second card transport paths P1, P2 in FIG. 1, a drive mechanism is arranged with a reversible drive pulse motor M1 and a reversible drive pulse motor M2 as a driving source. A timing pulley 61 (hereinafter referred to as simply a pulley) is fixed to a motor shaft of the pulse motor M1. An endless timing belt 62 (hereinafter referred to as simply a belt) is extended between the pulley 61 and a pulley 63. A pulley 64 having a diameter smaller than that of the pulley 63 is fixed to the pulley 63.

A belt 65 is trained between the pulley 64 and a pulley 66. A solenoid clutch 67 is attached to a shaft of the pulley 66. The solenoid clutch 67 interlocks a rotational drive of the pulley 66 to a pulley 68 fixed to a shaft of the solenoid clutch 67 only when an image is formed on the intermediate transfer sheet F by the thermal head 20 or the card C is transported upon printing by the direct printing method. The pulley 70 is fixed to the same shaft as the platen roller 21, and the belt 69 is trained between the pulley 68 and the pulley 70. Furthermore, the gear 71 having a diameter greater than that of the platen roller 21 engages a shaft of the platen roller 21. To the gear 71 is meshed gears 72 and 76. The gear 72 meshes with a gear 73 having the capstan roller 74 that presses against a pinch roller 75 on the same shaft. The gear 76 engages a gear 77 comprising a capstan roller 78 that presses against a pinch roller 79 on the same shaft.

Also, another belt 81 is trained to the pulley 64 for transmitting a rotational drive to the pulley 82. A gear 83 is fixed to a shaft of the pulley 82 to engage a gear 84. A gear 85 having a diameter smaller than that of the gear 84 is fixed to a shaft of the gear 84 to engage the gear 86. A torque limiter 87 is fixed to a shaft of the gear 86 so that a rotational drive force is transmitted to a back-tension roller 88 via the torque limiter 87. A pinch roller 89 is pressed against the back-tension roller 88. A clock plate 90 is fixed to a common shaft to the back-tension roller 88. As described later, when the intermediate transfer sheet F is transported in a reverse direction, the back-tension roller 88 rotates in synchronization with the intermediate transfer sheet F. A unit transmission sensor $S_7$ is disposed near the clock plate 90 to detect the rotation of the clock plate 90 to control a transport amount (an amount transported forward or in reverse) of the intermediate transfer sheet F.

A pulley 93 is fixed to a motor shaft of the pulse motor M2. A belt 94 is trained between the pulley 93 and a pulley 95. A gear 96 is fixed to a shaft of the pulley 95.

A one-way gear 97 engages the gear 96, and is fixed to a shaft that transmits a drive from the gear in the counterclockwise rotation and becomes free in the clockwise rotation (freely rotates). A gear 98 and a pulley 99 are fixed to a shaft of the one-way gear 97, and the gear 98 engages a one-way gear 101 that becomes free in the clockwise rotation and is locked in the counterclockwise rotation. A belt 102 is trained between the pulley 99 and a pulley 103. A gear 104 is fixed to a shaft of the pulley 103, and the gear 104 engages a gear 105. A torque limiter 106 is attached to a shaft of the gear 105 for transmitting a rotational drive to a gear 107 via the torque limiter 106. A clock plate 108 is fixed to a shaft same as that of the gear 107. The gear 107 engages a gear 109 that is fixed to a take-up spool shaft 110 to take up the intermediate transfer sheet F. A unit transmission sensor $S_8$ is disposed near the clock plate 108 to detect the rotation of a take-up spool shaft 110 via the rotation of the clock plate 108 as well as to detect any breakage of the intermediate transfer sheet F by monitoring the rotation of the take-up spool shaft 110.

Also, the gear 96 engages a one-way gear 111 that is fixed to a shaft. The shaft transmits the drive from the gear 96 in the counterclockwise rotation, and becomes free in the clockwise rotation. A gear 112 and a pulley 113 are fixed to a shaft of the one-way gear 111, and the gear 112 engages a one-way gear 114 that becomes free in the counterclockwise rotation and is locked in the clockwise rotation. A belt 115 is trained between a pulley 113, a pulley 116 and a pulley 125. To maintain a constant tension on the belt 115, a tension roller 126 is disposed between the pulley 116 and the pulley 125 that are connected by the belt 115. A gear 117 is fixed to a shaft of the gear 116, and engages the gear 118. A torque limiter 119 is fixed to a shaft of the gear 118 for transmitting a rotational drive to a gear 123 via the torque limiter 119. A clock plate 121 is fixed to a shaft same as that of the gear 123. The gear 123 engages the gear 124 that is fixed to the supply spool shaft 120 to supply the intermediate transfer sheet F. A unit transmission sensor $S_9$ is disposed near the clock plate 121 to detect the rotation of the supply spool shaft 120 via the rotation of the clock plate 121 as well as to detect any breakage of the intermediate transfer sheet F by monitoring the rotation of the supply spool shaft 120. The intermediate transfer sheet supply portion 16 is mounted to the supply spool shaft 120, and the sheet take-up portion 17 is mounted to the take-up spool shaft 110.

Also, a drive from the pulley 113 is transmitted to the pulley 125 via the belt 115. A gear 127 is fixed to a shaft of the gear 125, and engages a gear 128. The drive is transmitted to a gear 130 via a gear 129 disposed on a shaft same as that of the gear 128. A solenoid clutch 131 is fixed to a shaft of the gear 130. The solenoid clutch 131 interlocks a rotational drive of the gear 130 to the gear 131 via a gear 132 fixed to a shaft of the solenoid clutch 131 only when the intermediate transfer sheet F is rewound (Rv) for an image to be transferred to the intermediate transfer sheet F by the thermal head 20. A torque limiter 134 is fixed to a shaft of the gear 133, and a rotational drive is transmitted via the torque limiter 134 to the transport roller 58. Note that when the solenoid clutch 131 drive is interlocked, the supply spool shaft 120, the platen roller 21 and the transport roller 58 transport the intermediate transfer sheet F in different speeds. The speeds are set be an order of the supply spool shaft 120, the transport roller 58, and the platen roller 21 from fast to slow. Regarding the torque control, the torque is set to be an order of the platen roller 21, the transport roller 58, and the supply spool shaft 120 from large to small.

A rotational direction of the pulse motor M2 switches a direction of the intermediate transfer sheet F between a forward (Fw) and a reverse (rewind) (Rv). When the image is transferred on the intermediate transfer sheet F while rewinding (Rv), the transport speed of the intermediate transfer sheet F by the supply spool shaft 20, the platen roller 21 and the back-tension roller 88 is set to be an order of the supply spool shaft 120, the platen roller 21, the back-tension roller 88 from fast to slow. For this reason, when the intermediate transfer sheet F is separated from the thermal head 20 and is transported, the drive is cut by the solenoid clutch 67 to prevent slackening of the intermediate transfer sheet F.

Also, as described above, the intermediate transfer sheet transport buffer 100 is arranged between the guide roller 92 and the guide roller 4. The intermediate transfer sheet transport buffer 100 has a structure in which the guide roller 56 with both sides urged by a spring (not shown) can move in a direction traversing a line connecting the guide roller 92 and the guide roller 44 or in a direction opposite to the line (the arrow D and the opposite direction in FIG. 2). When forming an image simultaneously at both the image forming portion 9 and the transfer portion 10, a difference in transport speeds of the intermediate transfer sheet F between them is compensated. Note that the urging force of the spring toward the guide roller 55 is set to be larger than that toward the guide roller 56.

Figure 3:
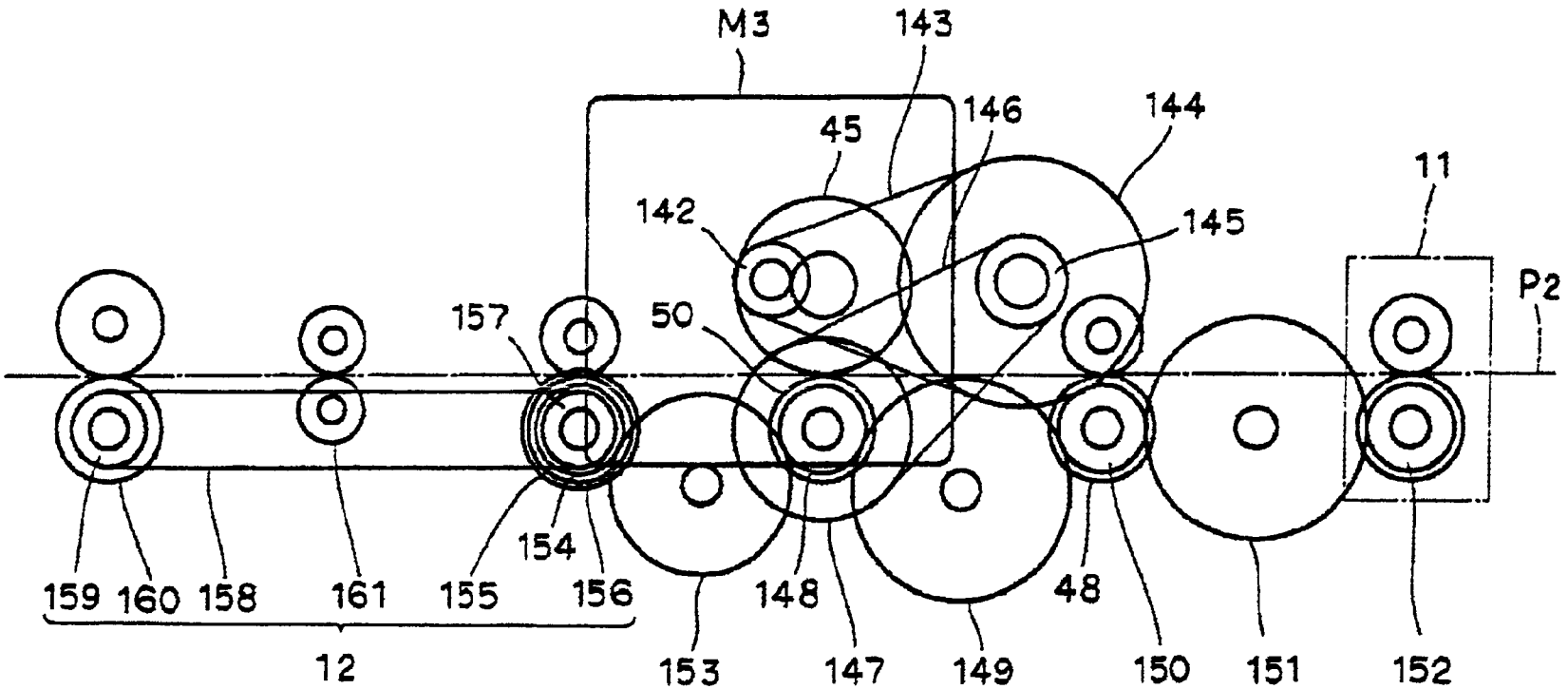
FIG. 3 is a front view of the card transport mechanism near the transfer portion of the printing apparatus according to the embodiment of the present invention.

As can be seen in FIG. 3, a card transport drive mechanism is disposed on the second card transport path P2, and uses a reversible pulse motor M3 as a drive source. A pulley 142 is fixed to a shaft of the pulse motor M3. A belt 143 is trained between the pulley 142 and a pulley 144. A pulley 145 is fixed to a shaft of the pulley 144, and has a diameter smaller than the pulley 144. A belt 146 is trained between the pulley 145 and a pulley 147. To a shaft of the pulley 147 are fixed the platen roller 50 and a gear 148 having a diameter smaller than that of the platen roller 50.

A gear 149 engages the gear 148, and has a diameter larger than that of the gear 148. The gear 149 engages a gear 150. The capstan roller 48, described above, having a diameter larger than that of the gear 150 is fixed to the gear 150 as a drive roller, and constitutes a pair of horizontal transport rollers by pressing the follower rollers on the second card transport path P2. A gear 151 engages the gear 150, and a gear 152 engages the gear 151. A drive roller having a diameter larger than the gear 152 is fixed to a shaft of the gear 152, and is composed of a pair of the horizontal transport rollers 11, described above. The drive roller is arranged to press the follower roller on the second card transport path P2.

A gear 153 engages the gear 148, and has a diameter larger than that of the gear 148. The gear 153 engages a gear 154. A pulley 157, a capstan roller 156 and a torque limiter 155 are fixed to a shaft of the gear 154. The pulley 157 has a diameter smaller than that of the gear 154, and the torque limiter 155 has a diameter larger than that of the capstan roller 156. The torque limiter 155 has a function that increases a speed when a trailing edge of the card C is released from the nip of the heat roller 45 and the platen roller 50 to ensure a peeling of the trailing edge of the card C and the intermediate transfer sheet F. A belt 158 is trained between the pulley 157 and a pulley 159. A discharge roller 160 is fixed to a shaft of the pulley 159 for discharging the transported card to outside of the frame 2. Follower rollers are disposed to press the capstan roller 156 and discharge roller 160 on the second card transport path P2. Note that a pair of free rollers 161 is disposed between the capstan roller 156 and the discharge roller 160 to correct a deformation of the card C like bending.

As can be seen in FIG. 1, on a line to the arrow direction L extended from the second card transport path P2 in the frame 2, a discharge outlet 27 is disposed to discharge the card C to outside of the frame 2 after printing. A detachable stacker 13 is attached to the frame 2 below the discharge outlet 27 for stocking a stack of the cards C. Note that a unit transmission sensor (not shown) is arranged at between the horizontal transport discharge portion 12 and the discharge outlet 27.

As shown in the FIG. 1, in the frame 2, the printing apparatus 1 is provided with a power supply unit 18 for converting a commercial AC power to a DC power to drive and operate each mechanism and control unit; the control unit 19 for controlling an entire operation of the printing apparatus 1; and a touch panel 8 disposed on the frame 2 for displaying a status of the printing apparatus 1 according to the information from the control unit 19, and allowing an operator to input an instruction to the control unit 19.

The control unit 19 includes a CPU block for processing on the-printing apparatus 1. The CPU block is composed of a CPU for operating under a fast clock speed as a central processing unit, a ROM for storing control instructions for the printing apparatus 1, a RAM working as a work area of the CPU, and an internal bus for connecting these components together.

An external bus is connected to the CPU block. To the external bus are connected a touch panel display operation control unit for controlling instructions and displays of the touch panel; a sensor control unit for controlling a signal from each of the sensors; an actuator control unit for controlling a motor driver to output a drive pulse to each of the motors and an actuator; an external I/O interface for communicating between an external computer and the printing apparatus 1; an thermal head control unit for controlling thermal energy of the thermal head 20; and a RAM for storing image information to be printed on the card C. The touch panel display operation control unit, the sensor control unit, the thermal head control unit and the actuator control unit are connected to the touch panel 8, the sensors including $S_1$ to $S_9$, the drivers including the pulse motor drivers of M1 to M3, the thermal head 20 and the solenoid clutches 67, respectively.

Next, operations of the printing apparatus 1 according to the embodiment of the invention will be explained with focusing on the CPU in the control unit 19. Assume that the image information received from an external computer via the external I/O interface has been stored in the RAM already.

The CPU displays an initial screen on the touch panel 8 via the touch panel display operation control unit, and is idle until an operator touches to select either of the mode A to mode E. The touch panel 8, at this point displays the mode A to mode E buttons, a mode clear button to clear the selected mode, a start button to start printing with the mode selected on the printing apparatus 1 and show that the printing apparatus 1 is in standby, read or how many sheets have been processed. In the Mode A, the apparatus prints an image directly on one side of the card C at the image forming portion 9 using the direct transfer method. In the Mode B, the apparatus forms an image on the intermediate transfer sheet F at the image forming portion 9 and then prints the image by transferring indirectly to one side of the card C at the transfer portion 10. In the Mode C, the apparatus forms an image on one side of the card C at the image forming portion 9 using the direct transfer method, then print both sides by transferring the image formed on the intermediate transfer sheet F at the image forming portion 9 onto the other side of the same card C at the transfer portion 10. In the Mode D for printing two cards consecutively (card Ca and card Cb), the apparatus forms an image on one side of the card Cb at the image forming portion 9 using the direct transfer method, then directly prints in high speed to form an image on the other side of the card C using the indirect transfer method. In the Mode E, the apparatus performs high speed indirect printing to execute image forming to the card C at the transfer portion 10 and to the intermediate transfer sheet F at the image forming portion 9 in parallel and consecutively. Note that in the following example, while the operator uses the touch panel 8 as the mode setting means to select either of the mode A to mode E, it is also perfectly acceptable to use a configuration where an external computer sends a command signal through a communication device as a mode setting device.

When the operator selects one of the mode A to mode E, the CPU remains idle until the start button is pressed. If the mode clear button is pressed before the start button, the selected mode is cleared and the CPU stays idle again until one of the modes is selected. When the start button is pressed, printing is executed according to a program stored in the ROM that corresponds to that mode. The following description explains each of the modes A to E in order. Explanations of the mode C and mode E that are the same as the mode A and mode B will be omitted and only different processes will be described.

(Mode A) First, the CPU activates the card supply portion 3 arranged on the second card transport path P2, the cleaner 4 and each of the rollers on the turning portion 6 to transport the card C from the card supply portion 3 to the arrow direction L in FIG. 1. In other words, the kick roller 31 on the card supply portion 3 rotates to transport the card C at the bottom of the card stacker to the second card transport path P2 where the cleaning roller 34 on the cleaner 4 cleans both sides of the card C. When the unit transmission sensor (not shown) arranged between the cleaner 4 and the pinch roller 38 detects a leading edge of the card C, the kick roller 31 on the card supply portion 3 is stopped rotating. After transporting from the unit transmission sensor to the turning portion 6 by a determined number of pulses, the card C is stopped (the pinch rollers 38 and 39 is also stopped rotating), and the turning portion 6 in a horizontal position nips the card C.

While the card C is nipped in the turning portion 6, the CPU starts the motor driver to rotate the pulse motor M1, and interlocks the solenoid clutch 67. The platen roller 21, the capstan roller 74 and the capstan roller 78 start rotating. Next, the CPU rotates the turning portion 6 by 90° to be in a vertical position to transfer the card C in the arrow direction U in FIG. 1 (a phantom line in FIG. 1). At this point, the pinch rollers 38 and 39 are driven to rotate and feed the card C along the first card transport path P1 toward the image forming portion 9. When the unit transmission sensor (not shown) arranged between the image forming portion 9 and the turning portion 6 detects the trailing edge of the card C, the CPU stops pinch rollers 38, 39 on the turning portion 6 after the card C is transported by a determined number of pulses.

During that time, the thermal head 20 is positioned away from the platen roller 21 (see FIG. 5A) and the thermal transfer sheet R is fed a determined distance to the printing position Sr, for example at a starting edge of Y (yellow). In order to control the position of the thermal transfer sheet R, the light emitting sensor S4 detects a trailing edge of the Bk (black) portion on the thermal transfer sheet R, and the unit transmission sensor (not shown) detects the rotation of the clock plate (not shown) disposed near a pair of the take-up rollers 57 to determine a distance between a trailing edge of the Bk (black) portion with a predetermined width and a starting edge of the Y (yellow) portion with a predetermined width on the thermal transfer sheet R.

The card C inserted into the image forming portion 9 is transported in the arrow direction U shown in FIG. 1 by the turning portion 6, capstan roller 78 and the pinch roller 79 on the first card transport path P1. After the unit transmission sensor arranged between the capstan roller 78 and the thermal head 20 detects the leading edge of the card C, the CPU transports the card C in the arrow direction U by the predetermined number of pulses to the printing starting position, then starts the thermal head sliding cam 23 to rotate. At this point, the platen roller 21 supports one side of the card C, and the other side of the card C is pressed against the thermal head 20 via the thermal transfer sheet R through the rotating action of the thermal head sliding cam 23 toward the arrow direction A in FIG. 5A.

The CPU converts image data for YMC into heat energy according to the image information in advance, and adds a specific coefficient according to a type of card C and intermediate transfer sheet F to the heat energy to be sent to the thermal head 20 as heating information. Each element of the thermal head 20 is heated according to the heating information. The pulse motor M1 drives the platen roller 21 to rotate in the counterclockwise direction. In synchronization, the thermal transfer sheet R is taken-up by the thermal transfer sheet take-up portion 15, and the Y (yellow) image is formed (printed) on the card C by the direct transfer method. (See FIG. 5B)

After forming the Y (yellow) image portion, the CPU rotates the thermal head sliding cam 23 further in the direction opposite to the arrow A in FIG. 5B, and retracts the thermal head 20 from the card C. The pulse motor M1 starts to rotate in reverse after the thermal head 20 is retracted. The platen roller 21, the capstan roller 74, the pinch roller 75, the capstan roller 78 and the pinch roller 79 start to rotate in reverse, and the card C is transported in the arrow direction D in FIG. 1. After the leading edge of the card C passes the unit transmission sensor (not shown) arranged between the capstan roller 78 and the thermal head 20, the CPU transports the card C by the predetermined number of pulses, stops the reverse rotational drive of the pulse motor M1. The CPU drives the pulse motor M1 to rotate forward to print the next die M (magenta). After the unit transmission sensor arranged between the capstan roller 78 and the thermal head 20 detects the leading edge of the card C, the CPU transports the card C in the arrow direction U by the predetermined number of pulses to the printing starting position. During that time, the CPU feeds the thermal transfer sheet R a little until a leading edge of the next color M (magenta) is positioned at the print starting position Sr. Then, by rotating the thermal head sliding cam 23 further in the arrow direction A, the thermal head 20 is pressed against the card C, therebetween interposed by the thermal transfer sheet R. The thermal head 20 forms the image of M (magenta) overlaying the previous color of Y (yellow) on the card C. The CPU repeats the processes in order to overlap images in the YMC inks on the card C. Note that printing on the backside of the card C often uses only one color of Bk (black). In such a case, an images is formed using only Bk (black) according to the same method described above, and image in YMC is not formed.

The CPU rotates the thermal head sliding cam 23 further in the direction opposite to the arrow A when the image forming on the card C is completed, and the thermal head 20 is retracted from the card C (See FIG. 5A). After the thermal head 20 is retracted, the CPU starts the pulse motor M1 to rotate in reverse after driving the pinch rollers 38 and 39 to rotate in reverse. The card C is transported in the arrow direction D in FIG. 1 by the reverse rotation of the platen roller 21, the capstan roller 74, the pinch roller 75, the capstan roller 78 and the pinch roller 79. With the card C nipped by the first turning portion 6, the reverse rotational drive of the pulse motor M1 and the interlocking of the solenoid clutch 67 are stopped, and the pinch rollers 38 and 39 are stopped rotating in reverse. Next, the CPU rotates the turning portion 6 by 90° to transport the card C in the arrow direction L in FIG. 1 while nipping the card C. The card C is positioned on the second card transport path P2.

The CPU drives the pinch rollers 38 and 39 on the turning portion 6 and each pair of rollers in the card transport drive mechanism (a pair of transport rollers 48 and horizontal transport rollers 48, and a plurality of rollers in the horizontal transport portion 12) to transport the card C in the arrow direction L in FIG. 1 on the second card transport path P2. Then, the CPU discharges the card C to the stacker 13 via the discharge outlet 27. The CPU stops the rollers on the second card transport path P2 after a determined amount of time from when a signal is received from the unit transmission sensor (not shown) arranged between the horizontal transport portion 12 and the discharge outlet 27, and displays the number of processed cards and process completion on the touch panel. Until when the number of cards input using the touch panel 8 are processed, the printing apparatus continues to print a single side of the next card C by the direct printing method in the same way as described above. Note that in the mode A as shown in FIG. 6A, the heat roller 45 is positioned away from the platen roller 50 in the transfer portion 10.

(Mode B) In a similar way to the mode A described above, the CPU drives each of the rollers in the card supply portion 3, the cleaner 4 and the turning portion 6, and then stops the turning portion 6 with the card C nipped in a horizontal position. Next, the CPU turns the turning portion 6 by 180° (inverting) to reverse the card C front to back, then stops the turning portion 6 with the card C nipped.

Next, the thermal head 20 heats the ink layer of the thermal transfer sheet R, and an image is formed on the reception layer Fe on the intermediate transfer sheet F. When forming the image, the pulse motor M1 rotates the platen roller 21 in the counterclockwise direction while the pulse motor M2 rotates to take-up the intermediate transfer sheet F on the intermediate transfer sheet supply portion 16. In synchronization, the thermal transfer sheet R is taken up on the thermal transfer sheet take-up portion 15. In other words, the CPU recognizes a positioning mark established on the intermediate transfer sheet F by monitoring the light emitting sensor S2. The CPU monitors the rotating amount of the clock plate 90, which is connected to the back-tension roller 88 that always rotates forward and reverse as one unit to feed or back up the intermediate transfer sheet F, to transport the intermediate transfer sheet F by a predetermined distance to the image print starting position. The thermal head 20 is positioned away from the platen roller 21, and, as described above, the thermal transfer sheet R is fed by a predetermined distance to the printing position Sr, for example to the starting edge of Y (yellow). The CPU rotates the thermal head sliding cam 23 further in the direction opposite to the arrow A in FIG. 5A when the starting edge of the Y (yellow) portion reaches the printing position Sr, and pushes the thermal head 20 against the platen roller 21 with the thermal transfer sheet R interposed therebetween. Simultaneously, the pulse motor M1 and the pulse motor M2 rotate in the reverse direction (Rv) The image in the color Y (yellow) is formed on the intermediate transfer sheet F (See FIG. 5C).

When the forming of the Y (yellow) image on the intermediate transfer sheet F is completed, the CPU rotates the thermal head sliding cam 23 to retract the thermal head 20 from the platen roller 21. By rotating the pulse motor M1 and the pulse motor M2 in the feeding direction (Fw), the take-up spool shaft 110 rotates in the counterclockwise direction and takes up the intermediate transfer sheet F until the positioning mark established thereupon passes the light emitting sensor S2. Next, in the same way for the Y (yellow) image, the CPU recognizes the positioning mark established on the intermediate transfer sheet F by monitoring the light emitting sensor S2. The CPU monitors the rotating amount of the clock plate 90, which is connected to the back-tension roller 88 that always rotates forward and reverse as one unit to feed or back up the intermediate transfer sheet F, and transports the intermediate transfer sheet F by a predetermined distance to the image print starting position. The thermal transfer sheet R is fed a little until the leading edge of the M (magenta) portion reaches the printing position Sr. In the same manner as the Y (yellow) image, the thermal head sliding cam 23 rotates again to touch the thermal head 20 to form an image of the M (magenta) portion onto the Y (yellow) portion on the receptive layer Fe on the thermal transfer sheet R. The CPU repeats the above described process in order to form images in layers using the YMC inks on the intermediate transfer sheet F, then retracts the thermal head 20 from the platen roller 21.

Note that the thermal control unit in the control portion 19 controls the thermal energy applied to the thermal head 20 when forming an image on the intermediate transfer sleet F to be lower than the thermal energy applied to the thermal head 20 when directly transferring to the card C (larger in directly transferring to the card C), since the base film of the intermediate transfer sheet F itself has a lower specific heat than the card C. Such a thermal energy is calculated by changing a coefficient of the thermal energy.

Next, the CPU drives the pulse motors M1 and M2 in the feeding direction (Fw) to transport the intermediate transfer sheet F to the heat roller 45 away from the platen roller 50 in advance, according to an amount of rotation of the clock plate 90 detected by the unit transmission sensor S7. Note that by monitoring the light emitting sensor S6 during the transportation, it is possible to detect the positioning mark on the intermediate transfer sheet F and adjust the transportation amount to improve the accuracy of the transportation. At this time, while transporting the intermediate transfer sheet F to the transfer portion 10, the CPU drives the pinch rollers 38 and 39 on the turning portion 6, a pair of horizontal transport rollers 11, a pair of transport rollers 48 and a plurality of rollers on the horizontal transport portion 12 to transport the card C in the arrow direction L in FIG. 1 over the second card transport path P2. In parallel to the transportation of the card C, the CPU activates the card supply portion 3 and the cleaner 4 to supply the next card C from the card supply portion 3 to the second card transport path P2, and, as described above, rotates the turning portion 6 in the horizontal position by 180° to invert the other card C front to back with the card nipped.

When the leading edge of the card C touches the heat roller 45, the CPU rotates the heat roller elevator cam 51 in the arrow direction B and shifts the heat roller 45 to touch tie platen roller 50, then stops the heat roller elevator cam 51. At this point, the backside of the leading edge of the card C is supported by the platen roller 50, and the front side thereof abuts against the heat roller 45 via the intermediate transfer sheet F. The CPU drives the pulse motor M2 in the feeding direction (Fw). While the backside of the card C is supported by the platen roller 50, and the front side thereof abuts against the heat roller 45 via the intermediate transfer sheet F, the card C is transported in the arrow direction L in FIG. 1. The peeling layer Fc on the intermediate transfer sheet F is peeled off the base film Fa by heat of the heating lamp 46, and the layer Fe formed thereupon with an image and the overcoat layer are transferred to the card C surface as a single body. In synchronization, the intermediate transfer sheet F is taken up by the intermediate transfer sheet take-up portion 17.

As shown in FIG. 7 in the mode B, the forming of Y (yellow) image onto the intermediate transfer sheet F at the image forming portion 9 is started in synchronization to the transfer of image formed on the intermediate transfer sheet F to the card C at the transfer portion 10. The transporting directions of the intermediate transfer sheet F at the image forming portion 9 and the transfer portion 10 are the same. However, the transporting speeds of the intermediate transfer sheet F at the image forming portion 9 and the transfer portion 10 are set separately to be suitable for each printing mechanism. Thus, the movement of the guide roller 56 absorbs a difference in the transport speeds of both mechanism in the intermediate transfer sheet transport buffer 100. At the image forming portion 9, after completing the image transfer at the transfer portion 10, an image is formed for the next color M (magenta) on the intermediate transfer sheet F. For that reason, the CPU releases the solenoid clutch 67 after the Y (yellow) image is formed at the image forming portion 9. Then, the CPU determines whether the transfer at the transfer portion 10 has been completed. If it is not the case, the CPU idles until the transfer at the transfer portion 10 is completed. On the other hand, if it is the case, the CPU interlocks the solenoid clutch 67 and forms the next M (magenta) image onto the intermediate transfer sheet F in the same way as described above.

When the transfer of the intermediate transfer sheet F to the front side of the card C is completed, the CPU stops the pulse motor M1 and the pulse motor M2 in the feeding direction, and re-rotates the heat roller elevator cam 51 to retract the heat roller 45 from the platen roller 50. The card C passes the horizontal transport portion 12, and is discharged to the stacker 13 through the discharge outlet 27. The next card C is printed by the indirect printing method in the same way.

(Mode C) In the mode C, a similar way to the mode A, the card C is transported in the arrow direction D in FIG. 1 after directly transferring to the card C at the image forming portion 9. While nipping the card C, the turning portion 6 is rotated by 90° to face the side of the card C opposite to the image side formed at the image forming portion 9 upward, and stops. Next, in the same way as the mode B, an image is formed on the intermediate transfer sheet F at the image forming portion 9, and the intermediate transfer sheet F is transported to the transfer portion 10 according to the rotating amount of the clock plate 90 detected by unit transmission sensor S7. While transporting the intermediate transfer sheet F, the card C nipped in the turning portion 6 is transported to the transfer portion 10 in parallel thereto, and in the same way as the mode B, after transferring the image to the other side of the card C, the card C is discharged to the stacker 13 through the horizontal transport path 12 and the discharge outlet 27. The next card C is printed by the double side printing method in the same way.

(Mode D) First, the CPU activates the rollers in the card supply portion 3, the cleaner 4, the turning portion 6 and the card transport drive mechanism to transport the card Ca along the second card transport path P2. After turning over by 180° at the turning portion 6, the card Ca passes through the transfer portion 10 moving further in the arrow direction L in FIG. 8. After the unit transmission sensors (not shown) arranged between the paired rollers 161 and the discharge roller 160 detects the leading edge of the card Ca, the card Ca is transported further in the arrow direction L by a predetermined number of the pulses, and a pair of rollers on the second card transport path P2 stop. The card Ca is nipped by a plurality of rollers in the horizontal transport path 12. Next, in the same manner as the mode B, after the forming of the image on the intermediate transfer sheet F at the image forming portion 9, the CPU moves a portion where the image is formed on the intermediate transfer sheet F to pass through the transfer portion 10, and transports it further to a position to be taken up on the intermediate transfer sheet take-up portion 17.

Next, the CPU again activates the rollers in the card supply portion 3, the cleaner 4 and the turning portion 6, and, in the same way as the mode A, the card Cb is nipped by the turning portion 6 in a horizontal position. The CPU starts the pulse motor M1 and the pulse motor M2 in the reverse (Rv) direction while interlocking the solenoid clutch 67. Next, the CPU rotates the turning portion 6 by 90°, and transports the card Cb to the image forming portion 9 whereat one side of the card Cb is printed using the direct transfer method. When the unit transmission sensor (not shown) arranged between the capstan roller 78 and the thermal head 20 detects the leading edge of the card Cb, the CPU transports the card Cb in the arrow direction U in FIG. 8 by a predetermined number of the pulses to the print starting position. The thermal head 20 touches the card Cb with the thermal transfer sheet R interposed therebetween, and at this point it starts forming the Y (yellow) image on the card Cb at the image forming portion 9. At the transfer portion 10, a portion of the intermediate transfer sheet F, where the image is formed and taken up by the intermediate transfer sheet take-up portion 17, is rewound.

Figure 8:
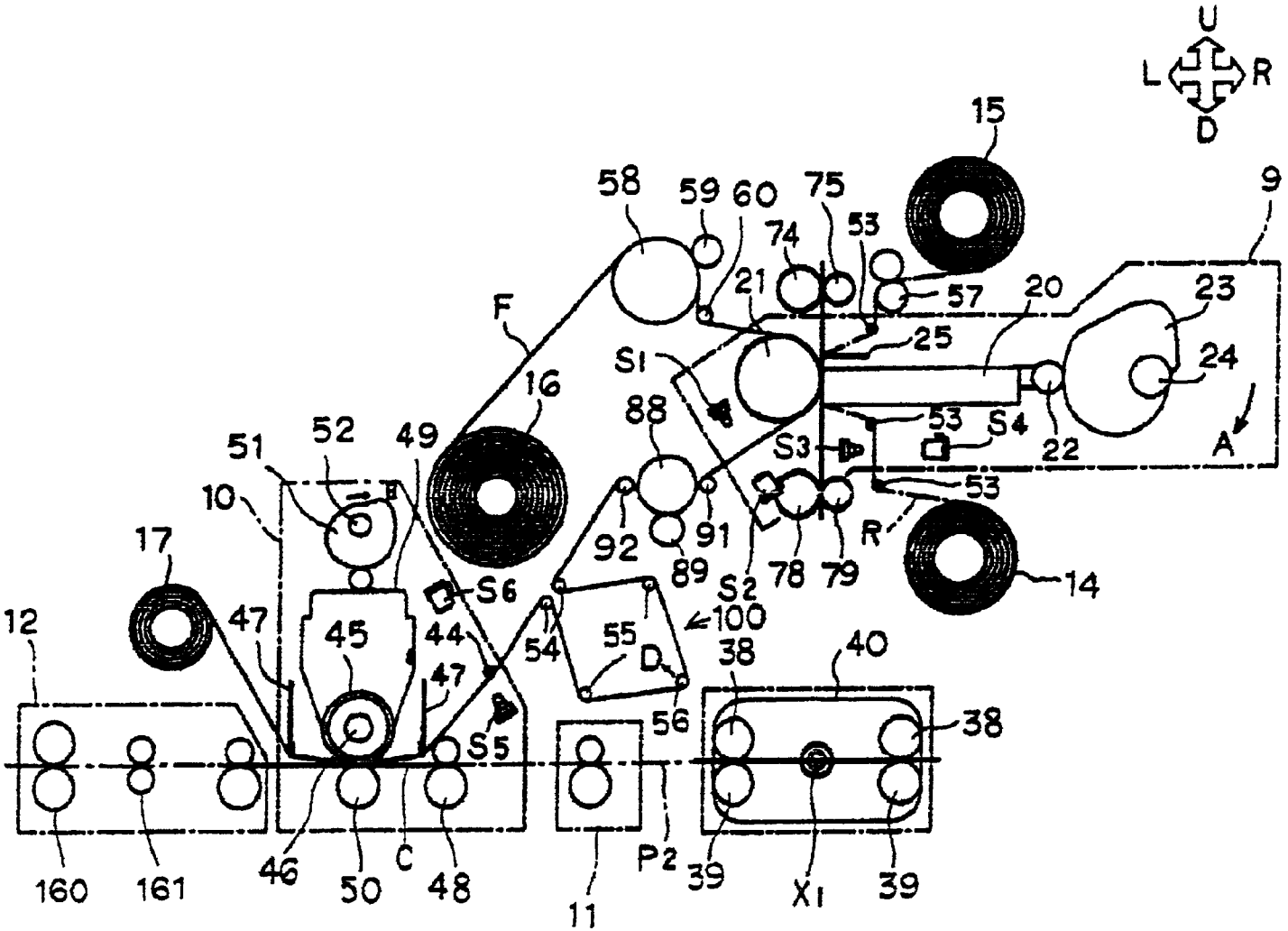
FIG. 8 is a front view of the printing apparatus according to the embodiment of the present invention, showing a state of mode D.

When the leading edge of the card Ca touches the heat roller 45 after being transported by a predetermined number of the pulses by the reverse rotation of the pulse motor M3, the CPU rotates the heat roller elevator cam 51 in the arrow direction B in FIG. 8, and shifts the heat roller 45 to touch the platen roller 50, then stops the heat roller elevator cam 51. At this point, a front side of the leading edge of the card Ca touches the heat roller 45 through the intermediate transfer sheet F, the backside thereof is supported by the platen roller 50. The pulse motor M2 rotates in the feed (Rv) direction, so one side of the card Ca abuts the heat roller 45 through the intermediate transfer sheet F, and the other side of the card Ca is supported by the platen roller 50 that rotates in the clockwise direction. The card Ca is transported in the arrow direction U in FIG. 8. A location of the intermediate transfer sheet F where the image is formed is transferred to the card Ca at the transfer portion 10. In synchronization, the intermediate transfer sheet supply portion 16 takes up the intermediate transfer sheet F.

As described above, because there is a difference in the transportation speeds of the intermediate transfer sheet F between the image forming portion 9 and the transfer portion 10, the intermediate transfer sheet transport buffer 100 absorbs the difference. At the image forming portion 9, after completing the image transfer at the transfer portion 10, the next color M (magenta) image is formed on the card Cb. When the forming of the Y (yellow) image at the image forming portion 9 is completed, the CPU releases the solenoid clutch 67. The CPU determines whether the unit transmission sensor (not shown) arranged near a pair of horizontal transport rollers 11 between a pair of horizontal transport rollers 11 and a pair of transport rollers 48 detects the leading edge of the card C to determine whether the transfer at the transfer portion 10 is completed. If it is not the case, the CPU stays idle until the transfer is completed at the transfer portion 10; if it is the case, while stopping the pulse motor M3, the CPU rotates the heat roller elevator cam 51 again to retract the heat roller 45 from the platen roller 50. This allows the card Ca to be nipped by a pair of horizontal transport rollers 11 and the transport roller 48.

Next, with the solenoid clutch 67 interlocked, as described above, while starting to transfer the next color M (magenta) on the intermediate transfer sheet F, the CPU drives the rollers in the card transport drive mechanism (driving the pulse motor M3). The card C passes the transfer portion 10 and the horizontal transport path 12, and is discharged to the stacker 13 through the discharge outlet 27. As described above in the mode A, the CPU continues to form the image in the next color C (cyan) at the image forming portion 9. When the image forming is completed, the card Cb is transported to the turning portion 6 to rotate by 90°, and then a pair of rollers in the card transport drive mechanism is driven to discharge the card Cb to the stacker 13. In the same way, it is continued to process the number of cards specified by the touch panel 8.

(Mode E) In an image forming step, first, as described in the mode B, the CPU heats the ink layer on the thermal transfer sheet R using the thermal head 20 to sequentially form the images in the colors of YMC on the reception layer Fe of the intermediate transfer sheet F. Then, the CPU retracts the thermal head 20 from the platen roller 21.

In a card nipping step, until the image forming step is completed, in the same way as described in the mode A, the CPU activates the rollers in the card supply portion 3, the cleaner 4 and the turning portion 6, and then stops the turning portion 6 in a horizontal position when it nips the card C. Next, the CPU rotates (inverts) the turning portion 6 by 180° and stops as the nipped card C is turned over front to back.

In a parallel transport step, next, the CPU drives the pulse motors M1 and M2, and transports the leading edge of the portion of the intermediate transfer sheet F where the image is formed in the image forming step. The leading edge passes the transfer portion 10 to the intermediate transfer sheet F according to the amount of rotation of the clock plate 90 detected by the unit transmission sensor S7, and moves to the take-up position on the intermediate transfer sheet take-up portion 17. At that time, the CPU drives the pinch rollers 38 and 39 and the pulse motor M3 to pass the card C nipped by the turning portion 6 through the transfer portion 10 in the arrow direction L in FIG. 9. After the unit transmission sensor(not shown) arranged between a pair of roller 161 and the discharge roller 160 detects the leading edge of the card C, the CPU transports the card C further in the arrow direction L by a predetermined number of the pulses and then stops the pinch rollers 38 and 39 and the pulse motor M3. This allows the card C to be nipped by a pair of rollers in the horizontal transport path 12.

In a parallel image forming step, the CPU starts the pulse motor M1 and pulse motor M2 in the take-up (reverse) direction and rewinds the trailing portion of the intermediate transfer sheet F where the image is formed to the transfer portion 10 according to the rotating amount of the clock plate detected by the unit transmission sensor S7. The CPU rotates the heat roller elevator cam 51 in the arrow direction R in FIG. 9, when the leading edge of the card C touches the heat roller 45 after transported by a predetermined number of the pulses by reverse rotation of the pulse motor M3. The CPU shifts the heat roller 45 to touch the platen roller 50, then stops the rotation of the heat roller elevator cam 51. At this point, the front side of the trailing edge of the card C touches the heat roller 45, and the backside of the card C is supported by the platen roller 50 through the intermediate transfer sheet F. The pulse motor M3 drives so that one side of the card C abuts the heat roller 45 through the intermediate transfer sheet F, and the other side of the card C is supported by the platen roller 50 that rotates in the clockwise direction. The card C is transported in the arrow direction U in FIG. 9. The location of the intermediate transfer sheet F with the image formed on is transferred to the card C at the transfer portion 10. In synchronization, the intermediate transfer sheet F is taken up by the intermediate transfer sheet supply portion 16. In parallel, at the image forming portion 9, the Y (yellow) image is formed on the intermediate transfer sheet F in the same way as the image forming step described above.

As there is a difference in the transportation speeds of the intermediate transfer sheet F between the image forming portion 9 and the transfer portion 10, the intermediate transfer sheet transport buffer 100 absorbs the difference. At the image forming portion 9, after completing the image transfer at the transfer portion 10, the next color M (magenta) image is formed on the intermediate transfer sheet F. When the forming of the Y (yellow) image at the image forming portion 9 is completed, the CPU releases the solenoid clutch 67. The CPU determines whether the unit transmission sensor (not shown) arranged near a pair of horizontal transport rollers 11 between a pair of horizontal transport rollers 11 and a pair of transport rollers 48 detects the leading edge of the card C to determine whether the transfer at the transfer portion 10 is completed. If it is not the case, the CPU stays idle until the transfer is completed at the transfer portion 10; if it is the case, while stopping the pulse motor M3, the CPU rotates the heat roller elevator cam 51 again to retract the heat roller 45 from the platen roller 50. This allows the card Ca to be nipped by a pair of horizontal transport rollers 11 and the transport roller 48. Next, the CPU drives the pulse motor M3. The card C passes the transfer portion 10 and the horizontal transport path 12, and is discharged to the stacker 13 through the discharge outlet 27. The CPU interlocks the solenoid clutch 67 to form the image in the next colors M (Magenta) and C (cyan) on the intermediate transfer sheet F at the image forming portion 9. In the same way, it is continued the steps of the card nipping, the parallel transport and the parallel image forming to process the number of cards specified by the touch panel 8.

Next, effects of the printing apparatus 1 according to this embodiment will be described.

The printing apparatus 1 according to the present embodiment comprises the image forming portion 9 for forming an image on the card C or the intermediate transfer sheet F, and the transfer portion 10 for transferring an image formed on the intermediate transfer sheet F to the card C. Thus, it is possible to print with both the direct transfer and indirect transfer printing methods. Also, as shown in the mode B to E, the printing apparatus 1 moves the thermal transfer sheet R relative to the card C or the intermediate transfer sheet F in the image forming portion 9. At the same time, the printing apparatus 1 execute a portion of the image transfer from the intermediate transfer sheet F to the card C in the transfer portion 10. Thus, it is possible to shorten the processing time to print a plurality of the cards C.

Also, because the printing apparatus 1 has the turning portion 6, it is possible to perform double-side printing on the card C, or perform either direct or indirect printing to one side or the other side of another card C to give a user higher flexibility.

Furthermore, using the control unit 19, the printing apparatus 1 can transport the card C on the second card transport path P2 by the pulse motor M3 and the intermediate transfer sheet F by the pulse motor M2 simultaneously. Thus, it is possible to shorten the transport time of the card C and the intermediate transfer sheet F in the printing process. Also, the printing apparatus 1 can transport the card C on the first card transport path P1 by the pulse motor M1 and the intermediate transfer sheet F by the pulse motor M2 simultaneously, so it is possible to shorten the transport time further.

Note that according to the embodiment of the present invention, to make the printing apparatus 1 more compact, the intermediate transfer sheet transport buffer 100 is configured to be rather small. Also, after completing the image transfer at the transfer portion 10 in the mode B to E, the M (magenta) image is formed on the card C or the intermediate transfer sheet F. However, by forming a larger intermediate transfer sheet transport buffer, or enlarging the intermediate transfer sheet transport buffer (an extra space) on the intermediate transfer sheet F, it is possible to freely rotate the pulse motors M1 and M2 forward or in reverse. Thus, it is possible to even further shorten processing times by continuing the thermal transfer of the M (magenta) and C (cyan) images after the Y (yellow) image at the image forming portion 9 without waiting for the completion of the transfer at the transfer portion 10. Also, in this embodiment of the present invention, the Y (yellow) image forming at the image forming portion 9 synchronizes with the image transfer at the transfer portion 10. However, since the image transfer at the transfer portion 10 needs to be completed just before completing the image forming at the image forming portion 9 (including forming of all YMC images), it is not necessary to simultaneously start the transfer at the transfer portion 10 when starting the Y (yellow) image forming at the image forming portion 9.

Still further, in this embodiment, the guide roller configuration is shown for the intermediate transfer sheet transport buffer 100, but it is perfectly acceptable to configure rollers, or employ an arm configuration such as the one disclosed in Japan Patent Publication (TOKKAI) No. 11-263032. Furthermore, this embodiment discloses a configuration wherein only the guide roller 56 moves, but it is also possible for the guide rollers 55 to move to enlarge the intermediate transfer sheet F buffer length.

Figure 9:
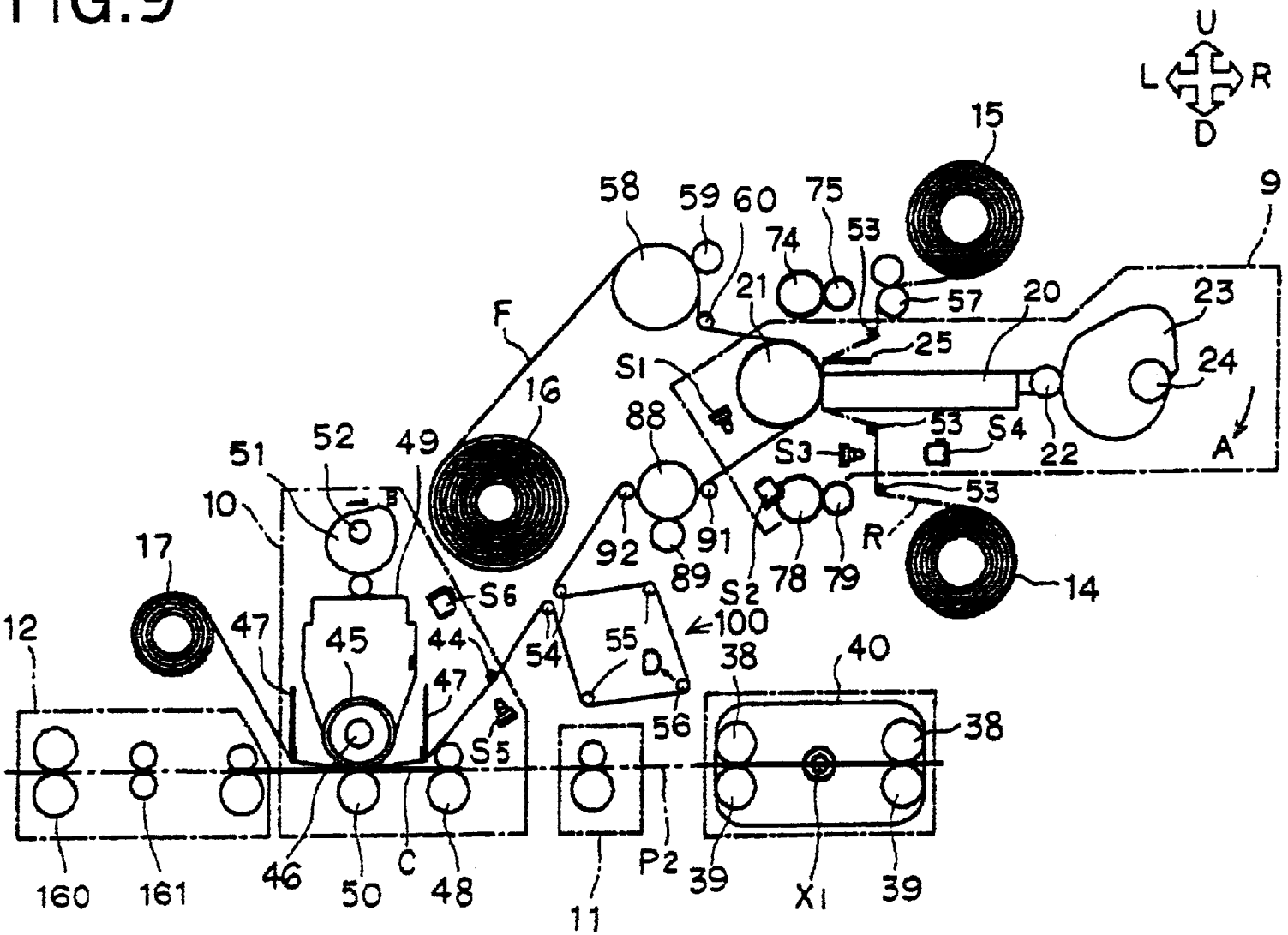
FIG. 9 is a front view of the printing apparatus according to the embodiment of the present invention, showing a state of mode E.

Still further, in this embodiment, the transfer in the transfer portion 10 is performed while transporting the card C (or Ca) in the arrow direction R in FIG. 8 and in FIG. 9, in the modes D and E. However, as shown in the mode B, it is also possible to transport the card C in the arrow direction L to transfer the image in the transfer portion 10. In that case, the card C stays idle while being nipped by a pair of transport rollers 48 and a pair of horizontal transport rollers 11, and the intermediate transfer sheet transport buffer of the intermediate transfer sheet F is made to be longer.

Also, in this embodiment, the intermediate transfer sheet F is take-up by the intermediate transfer sheet supply portion 16 when transporting the card C in the arrow direction U in FIG. 1. However, it is also acceptable to establish separate drive mechanisms for the intermediate transfer sheet F and the card C that are neither synchronized nor operated in parallel. Therefore, it is possible to arrange the thermal transfer sheet supply portion 14 and the thermal transfer sheet take-up portion 15 at opposite sides vertically.

Also, the embodiment has one image forming portion 9, however, this invention is not limited to one and can also comprise a plurality of image forming portions 9 (for example two). In this way, on one image forming portion, an image can be formed on the card C, and formed on the intermediate transfer sheet F at the other image forming portion, thereby further enhancing the printing speed and simplicity of the processing of this invention.

In this embodiment, the card C is discharged in a stack on the stacker 13 regardless of the printing methods on one side or the other side. However, a plurality of stackers 13 may be arranged, and a sorter may be disposed between the horizontal transport path 12 and discharge outlet 27 to discharge the card C separately. Also, an offsetting apparatus may be arranged between the horizontal transport path 12 and discharge outlet 27 to discharge the card C to the stacker 13 after printing the backside for printing the other side of the card C smoothly.

As described above, with this invention, the image is directly transferred to the recording medium by the first printing means and is indirectly transferred to the same recording medium or a different recording medium by the second printing means. Thus, it is possible to switch between the direct transfer method and the indirect transfer method to print the recording medium. The second printing means can form the image while transporting the thermal transfer film, or while transporting the intermediate transfer medium to and back during the first printing means is printing. Therefore, the image transfer to the recording medium using the second printing means and the image forming on the recording medium or the intermediate transfer medium using the first printing means can perform in parallel to each other, thereby reducing the printing processing time to print a plurality of recording media.

While the invention has been explained with reference to the specific embodiments of the invention, the explanation is illustrative and the invention is limited only by the appended claims.

What is claimed is:

1. A printing apparatus for printing a recording medium and an intermediate transfer medium, comprising:

a supply portion for storing the recoding medium, recording medium transport means disposed adjacent to the supply portion and having a transport path for transporting the recording medium from the supply portion along the transport path, at least one first printing means arranged on the transport path and having a thermal transfer film with an ink layer, said at least one first printing means forming an image on one of the recording medium and the intermediate transfer medium through the thermal transfer film, thermal transfer film transport means attached to the thermal transfer film for transporting the same, second printing means arranged on the transport path of the recording medium transport means for transferring the image formed on the intermediate transfer medium to a same or different recording medium, intermediate transfer medium transport means disposed adjacent to the second printing means for moving the intermediate transfer medium back and forth relative to the second printing means, and control means electrically connected to the recording medium transport means, the first printing means, the thermal transfer film transport means, the second printing means, and the intermediate transfer medium transport means for controlling the printing apparatus so that an image formation by the second printing means is performed parallel to a transfer operation of the thermal transfer film at a time of an image formation by the first printing means.

2. A printing apparatus according to claim 1, further comprising a recording medium turning portion arranged on the transport path between the first printing means and the second printing means for rotating the recording medium, said first printing means forming the image on one side of the recording medium and said second printing means forming the image on the other side of the same or different recording medium.

3. A printing apparatus for printing a recording medium and an intermediate transfer medium, comprising:

a supply portion for storing the recoding medium, recording medium transport means disposed adjacent to the supply portion and having a transport path for transporting the recording medium from the supply portion along the transport path, at least one first printing means arranged on the transport path for selectively forming an image on one of the recording medium and the intermediate transfer medium, second printing means arranged on the transport path for transferring the image formed on the intermediate transfer medium to the same or different recording medium, intermediate transfer medium transport means disposed adjacent to one of the first and second printing means for moving the intermediate transfer medium back and forth relative to the one of the first and second printing means, mode setting means for selecting one of a first mode in which said first printing means forms the image on the recording medium and a second mode in which the second printing means transfers the image formed on the intermediate transfer medium to the same or different recording medium, and control means electrically connected to the recording medium transport means, the first printing means, the second printing means, the intermediate transfer medium transport means, and the mode setting means for controlling the printing apparatus so that an image formation on the recording medium by the second printing means in the second mode is performed parallel to a back or forth movement of the intermediate transfer medium at a time of an image formation to the intermediate transfer medium by the first printing means.

4. A printing apparatus according to claim 3, further comprising parallel drive means for driving the recording medium transport means to transport the recording medium to the second printing means, and the intermediate transfer medium transport means to transport the intermediate transfer medium at a same time.

5. A printing method comprising:

a first image forming process of transporting one of a first recording medium and an intermediate transfer medium to a first image forming position, and forming an image on the one of the first recording medium and the intermediate transfer medium at the first image forming position, and a second image forming process of transporting a second recording medium to a second image forming position and transferring the image formed on the intermediate transfer medium to the second recording medium at the second image forming position, wherein at least a part of said first image forming process and a part of said second image forming process are performed simultaneously.

6. A printing method according to claim 5, wherein the image formation on the second recording medium in the second image forming process is performed at a back or forth movement of the first recording medium or the intermediate transfer medium in the image formation on the first recording medium or the intermediate transfer medium.

* * * * *